US008869406B2

(12) United States Patent
Votolato

(10) Patent No.: US 8,869,406 B2
(45) **Date of Patent: *Oct. 28, 2014**

(54) CUTTER WITH ANVIL

(75) Inventor: Earl Votolato, Newport Beach, CA (US)

(73) Assignee: The Votolato Living Trust, Newport Beach, CA (US)

( * ) Notice: Subject to any disclaimer, the term of this patent is extended or adjusted under 35 U.S.C. 154(b) by 151 days.

This patent is subject to a terminal disclaimer.

(21) Appl. No.: 13/528,473

(22) Filed: Jun. 20, 2012

(65) Prior Publication Data

US 2013/0340263 A1 Dec. 26, 2013

(51) Int. Cl.
*B26B 3/00* (2006.01)
*B67B 7/00* (2006.01)

(52) U.S. Cl.
USPC ..... 30/294; 30/280

(58) Field of Classification Search
USPC ..... 30/2, 123, 142, 175, 186, 294, 299
See application file for complete search history.

(56) References Cited

U.S. PATENT DOCUMENTS

| | | | | |
|---|---|---|---|---|
| 1,082,400 | A | 12/1913 | Burnite | |
| 1,553,449 | A * | 9/1925 | Kennedy | 30/294 |
| 1,963,564 | A * | 6/1934 | Smith et al. | 30/186 |
| 2,033,050 | A | 3/1936 | Pankonin | |
| 2,649,656 | A | 8/1953 | Hedrick | |
| 2,881,520 | A | 4/1959 | Mito | |
| 3,142,426 | A | 7/1964 | Busse | |
| 1,216,899 | A | 2/1971 | Weyer | |
| 3,727,272 | A | 4/1973 | Rhodes | |
| D235,306 | S | 6/1975 | Christian et al. | |
| D256,883 | S | 9/1980 | Wharmby | |
| D276,786 | S | 12/1984 | Chen | |
| 4,530,154 | A | 7/1985 | DiCarlo | |
| 4,581,823 | A | 4/1986 | Gilman | |
| 4,711,031 | A | 12/1987 | Annello | |
| D298,210 | S | 10/1988 | Hutson et al. | |
| 4,887,355 | A | 12/1989 | Colbert | |
| 5,007,171 | A | 4/1991 | Horning, Jr. | |
| 5,103,562 | A | 4/1992 | Braatz | |
| 5,115,568 | A | 5/1992 | Aida | |
| 5,357,679 | A | 10/1994 | Hanna | |
| 5,438,759 | A | 8/1995 | Dieringer | |
| D419,417 | S | 1/2000 | Kane | |
| 6,578,243 | B1 | 6/2003 | Hall | |
| 6,658,742 | B2 | 12/2003 | Votolato | |
| 6,966,244 | B2 * | 11/2005 | Herbst et al. | 81/418 |
| 7,073,264 | B2 | 7/2006 | Votolato | |
| D542,104 | S | 5/2007 | Holcomb et al. | |
| 7,506,445 | B2 | 3/2009 | Buyse et al. | |
| 7,891,100 | B2 | 2/2011 | Gelardi et al. | |
| 2005/0102844 | A1 | 5/2005 | Addis | |

(Continued)

FOREIGN PATENT DOCUMENTS

| | | |
|---|---|---|
| GB | 2234699 | 2/1991 |
| JP | 2000-279659 | 10/2000 |
| WO | 2008/086101 | 7/2008 |

*Primary Examiner* — Hwei C Payer
(74) *Attorney, Agent, or Firm* — Fish & Tsang LLP

(57) ABSTRACT

A cutting apparatus for opening a sealed package has a first arm partially enclosing a first blade that is at least partially juxtaposable against a second arm having a cutting surface. The two arms can be injection molded as a single piece of plastic or comprise two separate pieces coupled to a pivot. Preferably, the cutting surface comprises a raised portion at least partially enclosing a hard anvil.

26 Claims, 9 Drawing Sheets

(56) References Cited

U.S. PATENT DOCUMENTS

2006/0196018 A1 9/2006 Taylor et al.
2008/0134517 A1* 6/2008 Bosworth et al. ..... 30/114
2011/0030145 A1* 2/2011 Mandic ..... 7/107

* cited by examiner

CUTTER WITH ANVIL

FIELD OF THE INVENTION

The field of the invention is bag cutters.

BACKGROUND

Employment of sealed bags for housing various products is a well-accepted packaging approach. While such bags are highly desirable for their efficiency in maintaining product integrity, access into the contents of such bags is often inconvenient, and contents often spill due to messy cuts and tears.

Various cutters are available that attempt to overcome some of the problems described above. Such cutters include the devices described in International Patent Application Publication No. 2008/086101, and U.S. Pat. Nos. 7,073,264, 6,658,742, 4,887,355, and 5,007,171.

These and all other extrinsic materials discussed herein are incorporated by reference in their entirety. Where a definition or use of a term in an incorporated reference is inconsistent or contrary to the definition of that term provided herein, the definition of that term provided herein applies and the definition of that term in the reference does not apply.

The following background discussion includes information that may be useful in understanding the present invention. It is not an admission that any of the information provided herein is prior art or relevant to the presently claimed invention, or that any publication specifically or implicitly referenced is prior art.

Existing devices are not necessarily as durable, versatile, or safe as could be desired. Thus, there is still a need for improved cutting devices.

SUMMARY OF THE INVENTION

The inventive subject matter provides apparatus, systems and methods for cutting various objects, especially plastic bags, using a cutting device having a first arm partially enclosing a blade that is at least partially juxtaposable against a cutting surface.

The two arms are preferably made of plastic, and can advantageously be injection molded as a single, continuous piece of plastic. Also contemplated are a tab with a hole to accept a hanger, and the safety features of a locking strap and a ridge in one or both of the arms to help prevent a user's fingers from sliding off the arm.

There can be one, two or even more blades, each of which is preferably embedded in one of the arms. A second blade typically provides either a deeper cut, or a strip cut. Contemplated blades can have any suitable edge that mates with the anvil or other cutting surface, and include blades that have flat, concave or convex edges. Blades can be made of any suitable material, including steel, ceramic, and plastic. Stops can be included to control cutting depth.

Suitable anvils will typically have a convex surface, as for example in a cylinder or cone, and could even have a compound convex surface as in a ball.

Contemplated devices would typically be used by placing a bag between the cutting surface and the blade, and squeezing the arms together. When the two arms are pressed together so that a portion of the blade aligns with a cutting surface, a simple sliding motion could cut the bag open thereby allowing a user to conveniently access the bag's contents.

As used herein, a "cutting surface" means any surface that could be used in conjunction with a blade to create a cut.

Contemplated cutting surfaces include, among other things, a recessed portion of an arm, a raised portion of an arm, and/or an anvil.

Various objects, features, aspects and advantages of the inventive subject matter will become more apparent from the following detailed description of preferred embodiments, along with the accompanying drawing figures in which like numerals represent like components.

DETAILED DESCRIPTION

The following discussion provides many example embodiments of the inventive subject matter. Although each embodiment represents a single combination of inventive elements, the inventive subject matter is considered to include all possible combinations of the disclosed elements. Thus if one embodiment comprises elements A, B, and C, and a second embodiment comprises elements B and D, then the inventive subject matter is also considered to include other remaining combinations of A, B, C, or D, even if not explicitly disclosed.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

Figure 1:
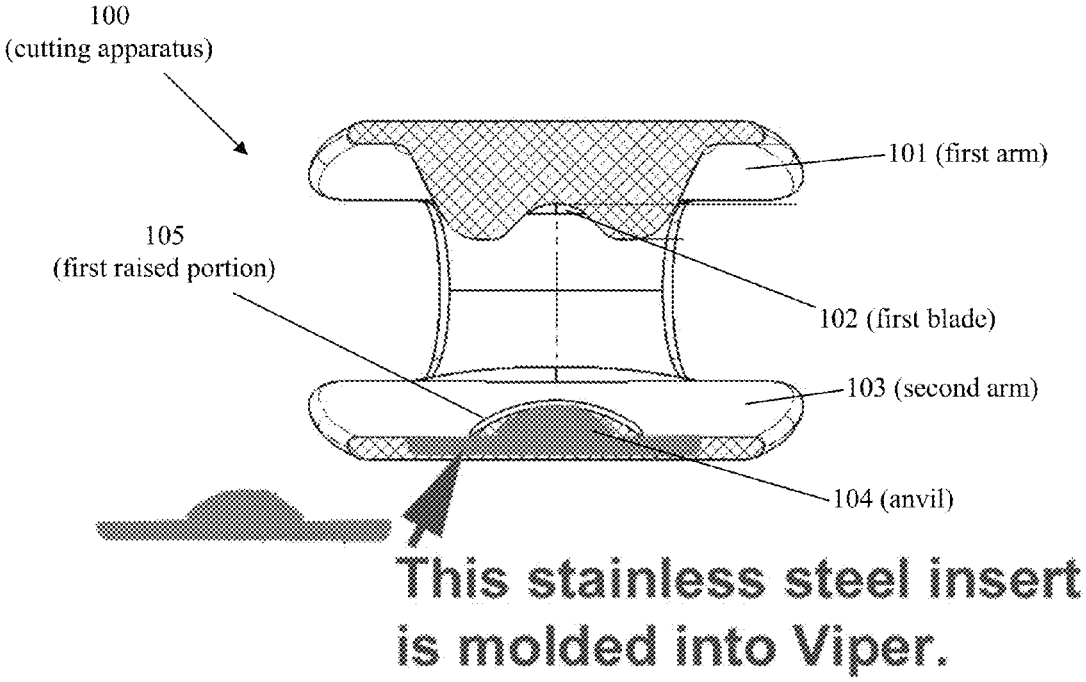
FIG. 1 is a front view of a cutting apparatus incorporating some aspects of the inventive subject matter.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims In FIG. 1, a cutting apparatus 100 generally has a first arm 101 carrying a first blade 102, and a second arm 103 carrying a first raised portion 105 that encloses an anvil 104.

It is contemplated that each of the first blade 102, the first raised portion 105, and the first anvil 104 could be located on any portion of any arm. As used herein, the term "raised" with respect to a component means that a portion of the raised component is elevated above an adjacent surface or edge by at least 1 mm, and more preferably at least 4 mm, and more preferably at least 7 mm.

The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

The first and second arms 101 and 103 of a cutting apparatus 100 could comprise a single continuous piece of material, or could comprise two or more separate pieces of material. Contemplated materials include metals and steel. However, preferred materials include various types of plastics, such as acrylics, polyesters, silicones, polyurethanes, halogenated plastics, and all materials or polymers having sufficient flexibility to bend and sufficient rigidity to maintain the overall shape of the apparatus during repeated use.

The first blade 102 is preferably juxtaposable against a cutting surface (104 and/or 105). It is contemplated that the edge of the blade could be flat, concave, or convex at juxtaposition with the cutting surface. The blade could be made of any suitable material or materials, including for example, a steel, a plastic, a ceramic, a bronze, a copper, or any combination thereof.

While the first blade 102 could be on either the first 101 or second arm 103 of the cutting apparatus 100, the cutting surface to which the first blade is juxtaposable is preferably on a different arm. For example, a cutting apparatus 100 comprising a first blade 102 on a first arm 101 can have a cutting surface on a second arm 103. A cutting apparatus 100 comprising a first blade 102 on a second arm 103 can have a cutting surface on a first arm 101. Thus, it is contemplated that either one of the first and second arms could serve as a base.

One possible cutting surface is an anvil 104. As used herein, an "anvil" 104 is any separate piece of a hard material or materials that is at least partially inserted into and/or molded into at least one of an arm (101 or 103) or a raised portion 105 of the cutting apparatus 100. The anvil 104 can be of any suitable size and shape, including for example, a blade, a ball, a compound convex surface, a cylinder, a cone, or any other suitable shape. The anvil 104 could be made of any suitable material or materials, such as a steel, a plastic, a ceramic, a bronze, a copper, or any combination thereof that is of a sufficient hardness to act as a cutting surface for a blade. It is contemplated that an exposed portion of anvil 104 could comprise a different material than other portions of the anvil 104. Any and all portions of the anvil 104 could comprise a material that is harder, of the same hardness, or softer than the material used on an arm to which it is coupled. It is further contemplated that the anvil could comprise the same material as an arm to which it is coupled.

Figure 2A:
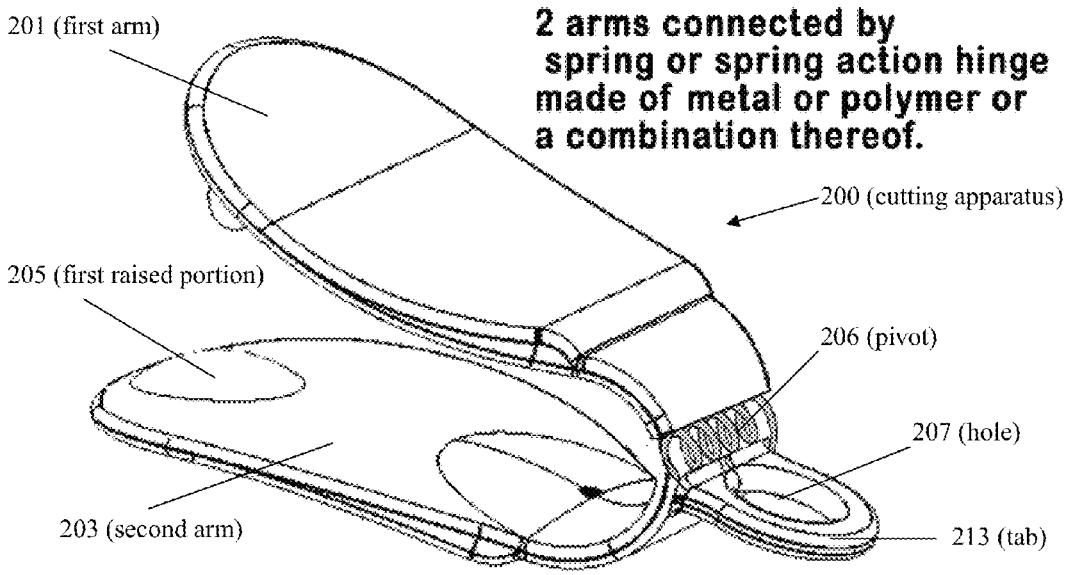
FIG. 2A is a perspective view of a cutting apparatus having two distinct arms coupled by first a pivot.
Figure 2B:
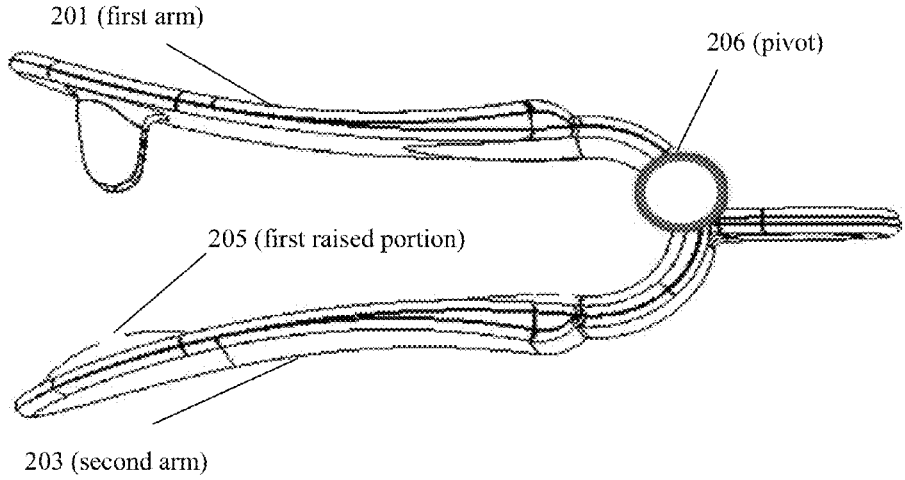
FIG. 2B is a side view of a cutting apparatus having two distinct arms coupled by a second type of pivot.

In FIGS. 2A-2B, a cutting apparatus 200 generally comprises a first arm 201 and a distinct second arm 203, which are each coupled (e.g. conjoined) to a pivot 206 (e.g. a hinge). The second arm 203 of the cutting apparatus 200 comprises a first raised portion 205 that is juxtaposable against at least a portion of the first blade (not shown).

As used herein, a "pivot" means any piece(s) of material or materials that couple one arm with another arm, such as a hinge, a spring, or piece(s) of plastic.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

Cutting apparatus 200 has a tab 213 with a hole 207, which is configured to accept a hanger such that a single long hanger that could hold a plurality of cutting apparatuses. Alternatively, a hole could be located on any portion(s) of the cutting apparatus 200, including for example, any portion of the first arm 201 and/or second arm 203.

In embodiments such as the ones shown on FIGS. 2A and 2B, it is contemplated that the first arm 201 could comprise one type of material, the second arm 203 could comprise a different type of material, and the pivot 206 could comprise yet another different type of material. Alternatively, the first arm 201, the second arm 203, and the pivot 206 could have at least one type of material in common.

Figure 3:
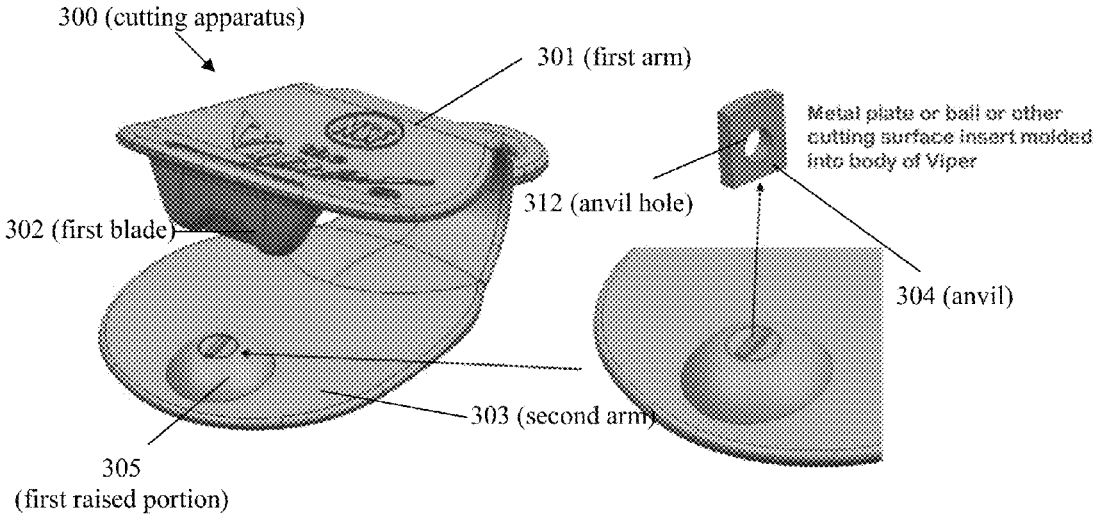
FIG. 3 is a perspective view of a cutting apparatus having an anvil comprising a through-hole.

FIG. 3 illustrates another embodiment of the inventive subject matter, and includes a close-up of one type of anvil 304. Cutting apparatus 300 has a first arm 301 partially enclosing a first blade 302, and a second arm 303 having a first raised portion 305, which partially encloses an anvil 304.

In this particular embodiment, anvil 304 comprises a through-hole 312 that mates with an internally facing detent in raised portion 305 or second arm 303 to hold the anvil 304 in place. The long axis of anvil 304 is disposed orthogonal to the long axis of blade 302, thereby reducing the size of the cut made. Alternatively, the long axis of anvil 304 could be disposed parallel to, or diagonal to, the long axis of the anvil 304. It is further contemplated that the anvil 304 could be rotatable, either alone, or along with a piece of the raised portion 305, thereby allowing a user to switch the size of the cuts made by the cutting apparatus 300.

In preferred embodiments, the anvil 304 is removable and/or replaceable with another anvil (not shown) to provide durability. The replacement anvil could either be the same type (material and/or shape) as anvil 304, or a different type of anvil. Alternatively, anvil 304 could be permanently embedded into the raised portion 305 of the cutting apparatus 300.

Figure 4A:
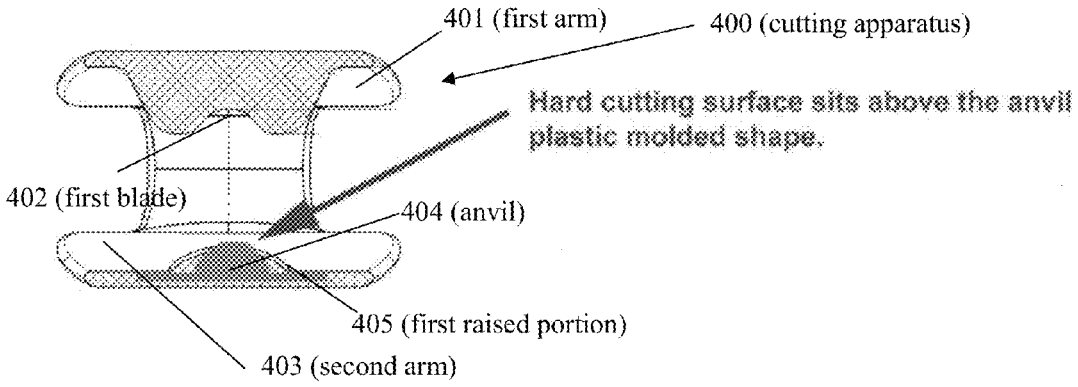
FIG. 4A is a front view of a cutting apparatus having an anvil partially enclosed by an arm.
Figure 4B:
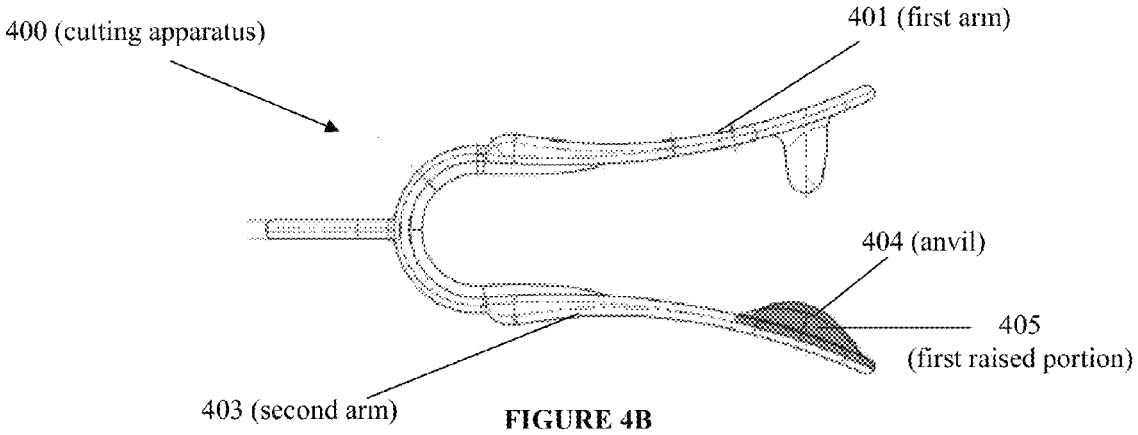
FIG. 4B is a side view of a cutting apparatus having an anvil partially enclosed by an arm.

In FIGS. 4A-4B, anvil 404 of cutting apparatus 400 extends above raised portion 405 so that the anvil serves as the cutting surface. With repeated use, anvil 404 could wear down to an extent that both the anvil 404 and the raised portion 405 could serve as the cutting surface. In other embodiments, the anvil is completely embedded within the raised portion (See FIG. 1). In such embodiments the raised portion at least initially serves as the cutting surface. With normal wear and tear, it is contemplated that the anvil could become sufficiently exposed to serve as a cutting surface, either alone, or in conjunction with the cutting surface.

The raised portion 405 could be an extension of one of the first 401 and second arms 403, or could be a different piece of material coupled thereto. Where a different type and/or separate piece of material is used for the raised portion 405, it is contemplated that the material could be softer, harder, or equal in hardness to the material of one or more of the arms. Suitable materials include all materials suitable for any portion of a cutting apparatus.

Each of the first arm 401, second arm 403, blade 402, raised portion 405, and anvil 404 could comprise any suitable shape and be of any suitable size. Nevertheless, in preferred embodiments the entire cutting apparatus could easily be held and operated using a single hand.

Figure 5:
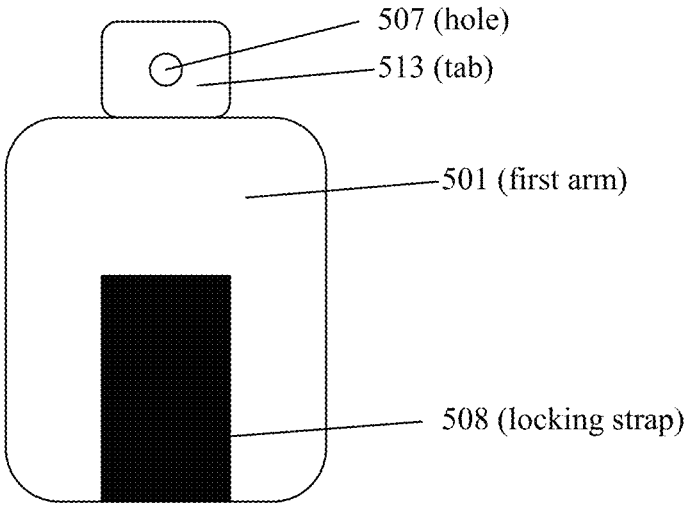
FIG. 5 is a top view of a cutting apparatus comprising a locking strap.

In FIG. 5, the cutting apparatus has a tab 513 comprising a hole 507, which is configured to accept a hanger (not shown) in a manner analogous to hole 207 in FIG. 2. Cutting apparatus 500 also has a locking strap 508, which could be removably or non-removably coupled to the first or second arm, and configured to removably attach to the remaining arm. The locking strap 508 could be made of any material or materials, including for example, a nylon, a cotton, a leather, and/or any other suitable material with sufficient flexibility to wrap around a portion of a cutting apparatus. It is contemplated that the mechanism used to removably attach the locking strap to an arm could comprise a hook and loop fastener, a button, a clip, a slider, or any other suitable mechanism that allows a user to repeatedly remove and attach the locking strap from the remaining arm.

Figure 6:
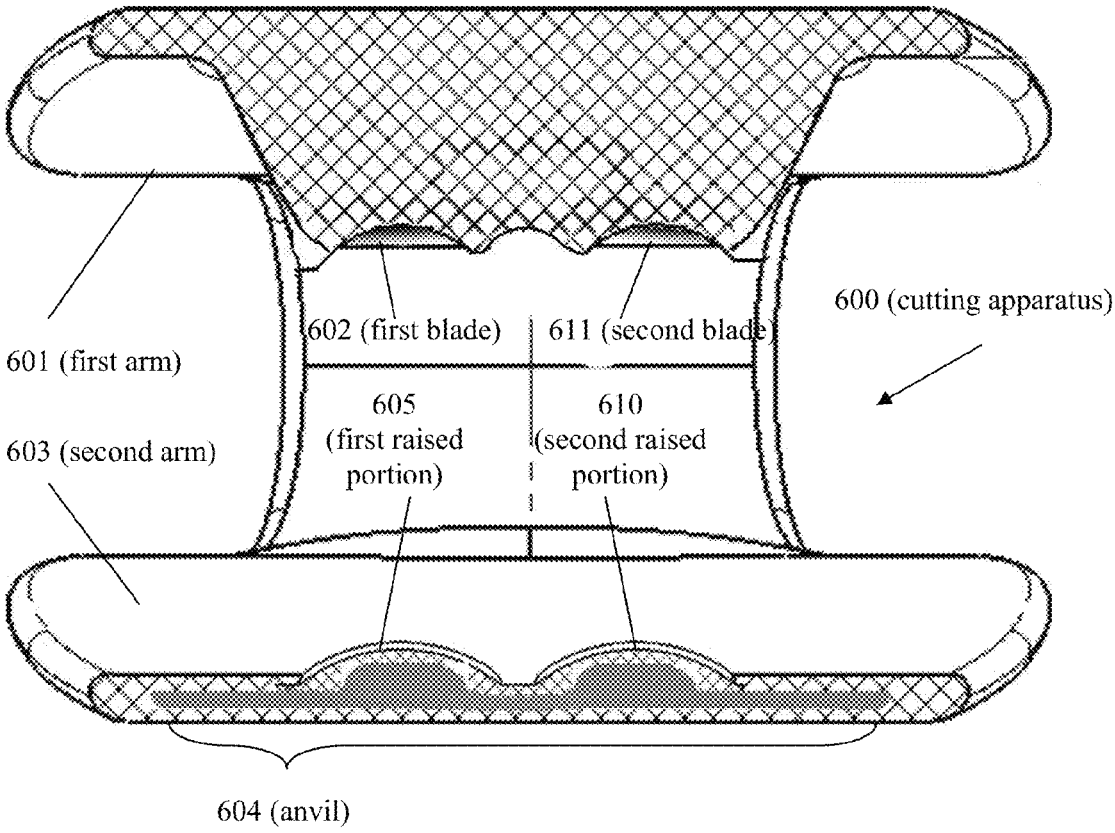
FIG. 6 is a front view of a cutting apparatus having two blades and two raised portions.

In FIG. 6, a first arm 601 of cutting apparatus 600 partially embeds a first blade 602, and a second blade 611, while a second arm 603 comprises a first raised portion 605 and a second raised portion 610. The blades 602 and 611 could be aligned in relation to each other in any suitable manner. The blades 602 and 611 could be aligned side by side so that they run across the same portion of the bag or other object consecutively (as shown in FIG. 6), and/or they could be aligned above and below one another so that the two blades run across different portions of the bag or other object simultaneously. It is contemplated that the alignment of the blades 602 and 611 could be mirrored by the alignment of the first and second raised portions 605 and 610. It is also contemplated that the first and second blade and/or the first and second raised portions could reside on a rotatable piece(s) of material so that the alignment of the two blades and/or two raised portions, relative to an arm, could be changed by a user.

It is contemplated that the first raised portion 605 and second raised portion 610 could be of the same size and shape as one another, or be of different sizes and shapes, relative to one another. Moreover, it is contemplated that the first blade 602 and second blade 611 could protrude out away from the first arm 601 at a same distance, or protrude out at different distances.

The first raised portion 605 and second raised portion 610 could each comprise a separate anvil. Alternatively, first and second raised portion (605 and 610) could share a single anvil 604 (as shown in FIG. 6). Still further, it is contemplated that the first and second raised portions (605 and 610) could be without an anvil (as shown in FIG. 7).

Figure 7:
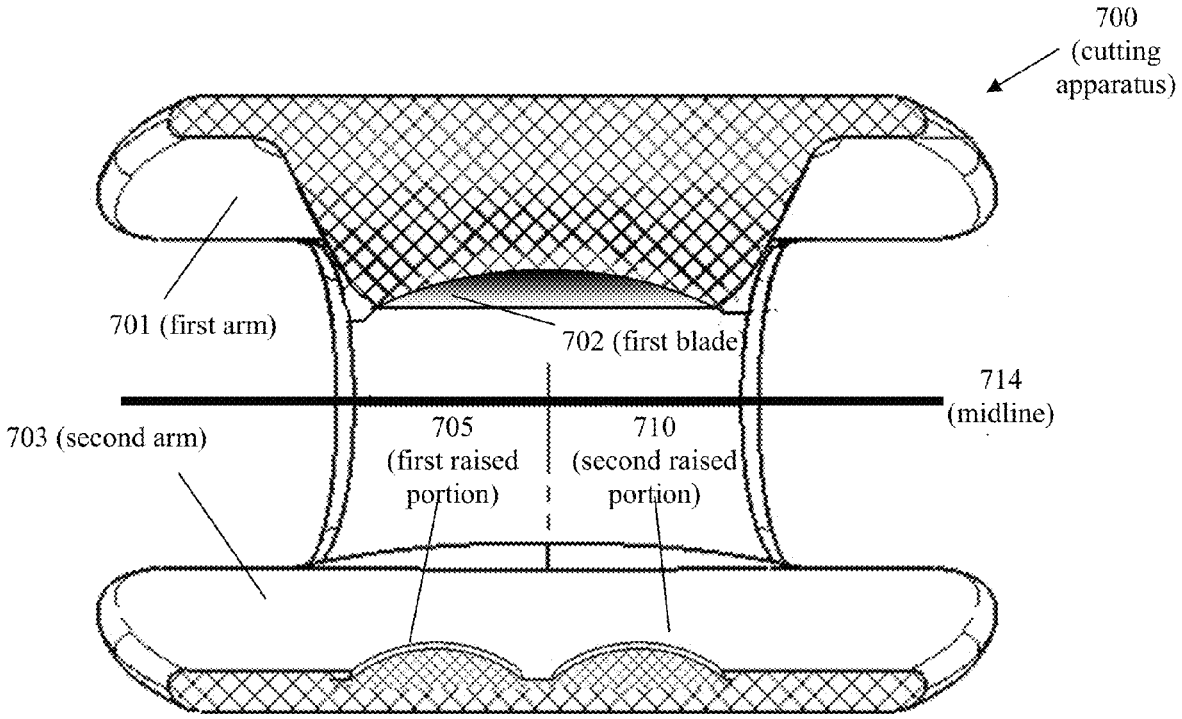
FIG. 7 is a front view of a cutting apparatus having one blade and two raised portions.

An alternative but similar embodiment to the one shown in FIG. 6 is the cutting apparatus 700 shown in FIG. 7. Cutting apparatus 700 comprises a first arm 701 comprising a first blade 702, which is juxtaposable against both a first raised portion 705 and a second raised portion 710 on a second arm 703. It is contemplated that the blade 702 and juxtaposable raised portions 705 and 710 could be positioned at any angle relative to the midline 714 of the cutting apparatus 700. For example, the first blade 702 and raised portions 705 and 710 could be parallel to the midline 714 (as shown in FIG. 7), perpendicular to the midline 714, or positioned at any angle in between.

Figure 8A:
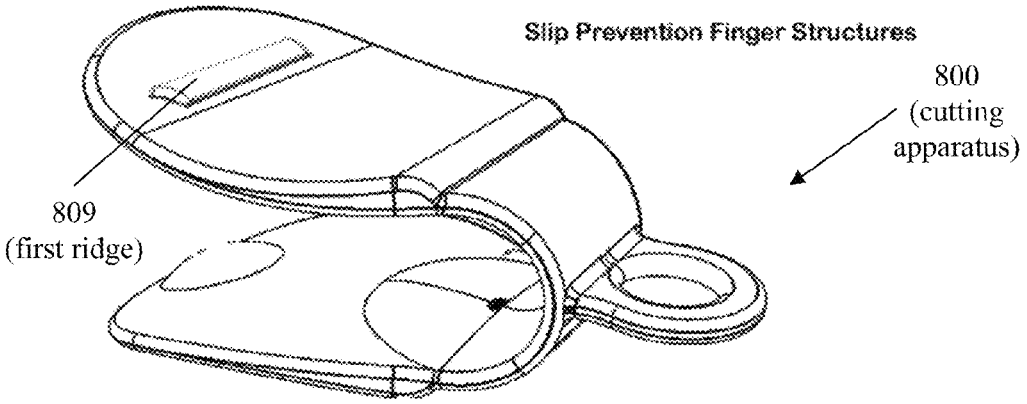
FIG. 8A is a perspective view of a cutting apparatus having a first type of slip prevention ridge.
Figure 8B:
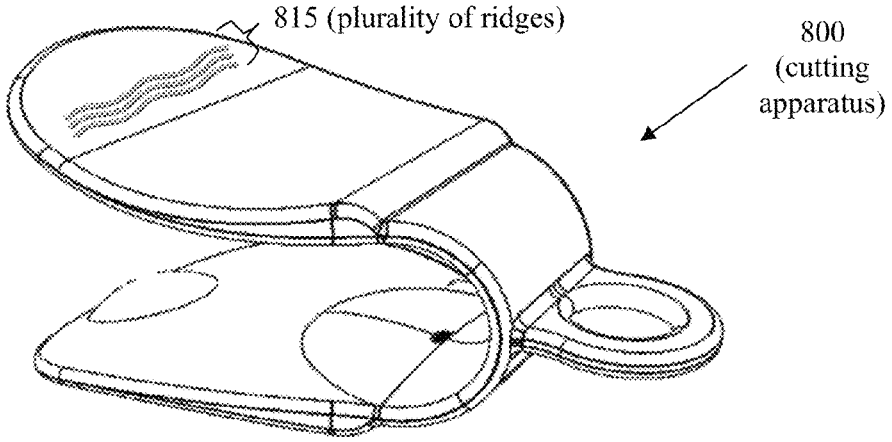
FIG. 8B is a perspective view of a cutting apparatus having a second type of slip prevention ridge.
Figure 8C:
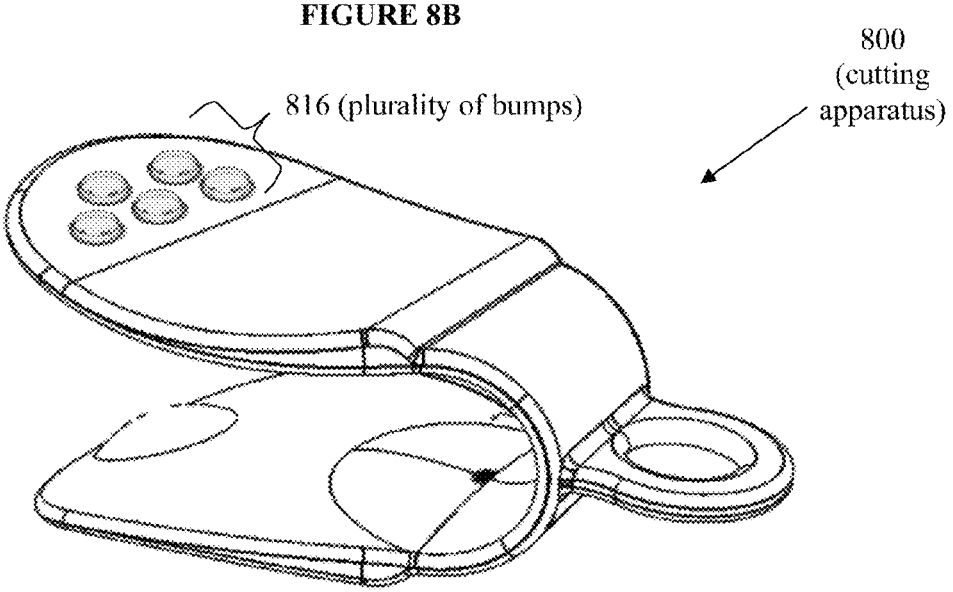
FIG. 8C is a perspective view of a cutting apparatus having a third type of slip prevention ridge.

In some embodiments, such as the one shown in FIGS. 8A-8C, cutting apparatus 800 could comprise a non-slip mechanism, such as a single ridge 809, a plurality of ridges 815, or a plurality of bumps 816. Such ridges and bumps could be useful to stop a user's fingers from slipping off the apparatus while in use. Other contemplated embodiments could include a piece of a rubber or other non-slip material, a dent configured to accept a finger, or any other suitable measure to prevent slippage during use. It is contemplated that a non-slip mechanism can be located on any outer portion of the cutting apparatus 800.

Figure 9A:
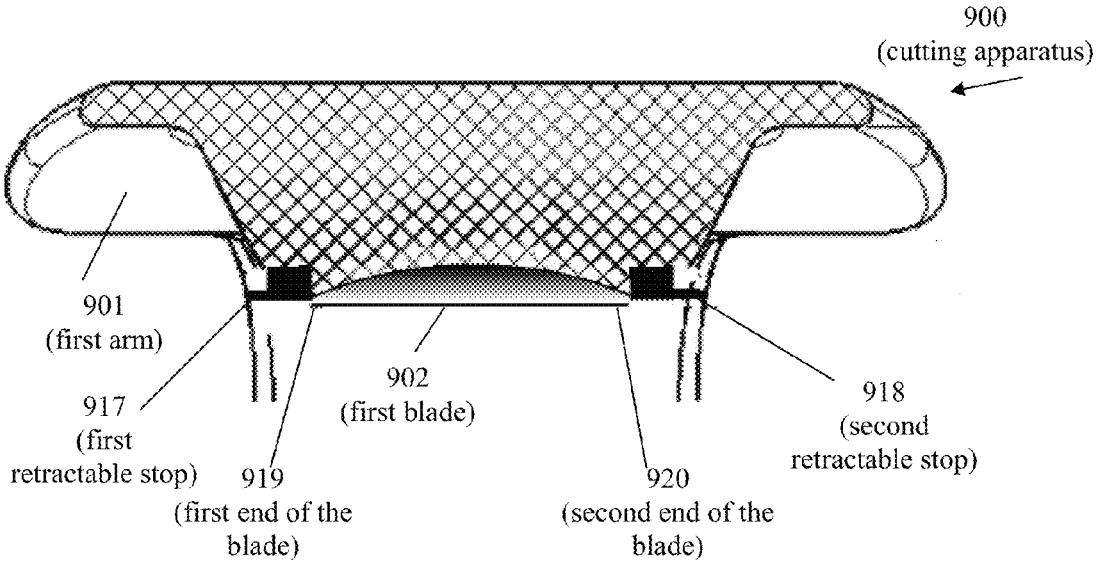
FIG. 9A is a front-partial view of a cutting apparatus having two retractable stops.
Figure 9B:
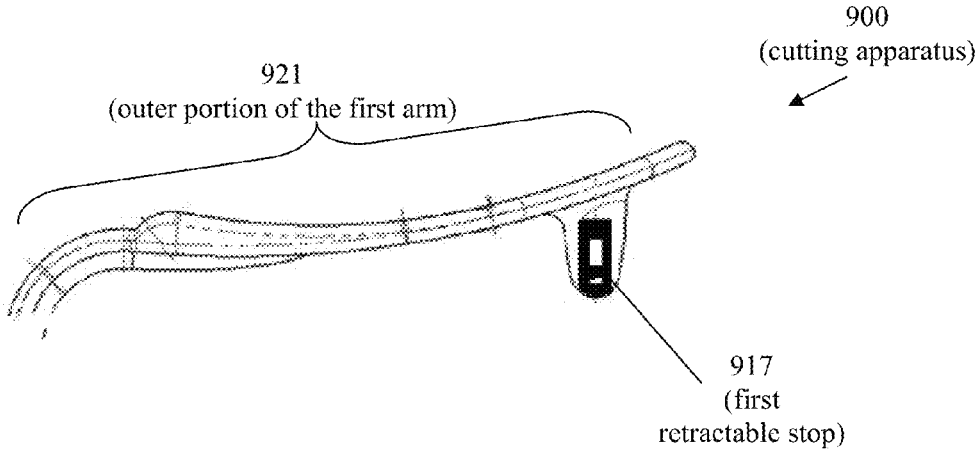
FIG. 9B is a side-partial view of a cutting apparatus having a retractable stop.

In FIGS. 9A-9B, a portion of the first arm 901 of a cutting apparatus that surrounds the first blade 902 comprises a first and second retractable stop, 917 and 918 respectively. Such retractable stops 917 and 918 could be used to increase and/or decrease the depth of the blade 902 that is exposed at first and second ends, 919 and 920 of the blade 902 respectively. Such embodiments allow a user to control the depth of a cut made by cutting apparatus 900. For example, when a user wants to cut into a single side of a bag rather than both sides of a bag, she can detract the retractable stops (917 and 918). When a user wishes to cut through a thicker bag or other piece of material, she can retract the stops (917 and 918) to expose a larger depth of the blade. Moreover, the user could retract the first stop 917 and detract the second stop 918, then flip the second arm (not shown) over to use the blade as a box cutter. When the second arm is flipped over the first arm 901, it is contemplated that the outer portion of the first arm 921 will directly face an outer portion of the second arm (not shown).

It should be apparent to those skilled in the art that many more modifications besides those already described are possible without departing from the inventive concepts herein. The inventive subject matter, therefore, is not to be restricted except in the scope of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. A cutting apparatus comprising:

a first arm and an opposable second arm;

a first blade comprising an edge, wherein the edge has a first end, a second end and a central portion;

the first arm partially enclosing the first blade at the first end and the second end in a manner that exposes the central portion of the edge of the first blade wherein portions of the first arm partially enclosing the first end and the second end project beyond the central portion;

a first raised portion on the second arm at least partially enclosing an anvil, wherein the anvil comprises a first material, and the second arm comprises a second material different from the first material; and wherein at least one of the first raised portion and the anvil is juxtaposable against at least a first segment of the central portion of the edge of the first blade.

2. The apparatus of claim 1, wherein the first arm is continuous with the second arm.

3. The apparatus of claim 1, wherein the first arm is conjoined with the second arm at a pivot.

4. The apparatus of claim 1, wherein the first arm and the second arm comprise a continuous piece of plastic.

5. The apparatus of claim 1, wherein the first blade is embedded in the first arm.

6. The apparatus of claim 1, wherein the central portion is flat at a juxtaposition with the anvil or the first raised portion, and wherein the anvil or the first raised portion comprises a bubble surface.

7. The apparatus of claim 1, wherein the central portion of the edge of the first blade is concave at a juxtaposition with the anvil or the first raised portion.

8. The apparatus of claim 1, wherein the central portion of the edge of the first blade is convex at a juxtaposition with the anvil or the first raised portion.

9. The apparatus of claim 1, wherein the anvil is not a blade.

10. The apparatus of claim 1, further comprising a first retractable stop at a first portion of the first arm touching the first end of the edge of the first blade.

11. The apparatus of claim 10, further comprising a second retractable stop at a second portion of the first arm touching the second end of the edge of the first blade.

12. The apparatus of claim 1, wherein the first blade has a long axis parallel to a long axis of the anvil.

13. The apparatus of claim 1, wherein the first blade has a long axis orthogonal to a long axis of the anvil.

14. The apparatus of claim 1, wherein the anvil comprises a compound convex surface.

15. The apparatus of claim 1, wherein the anvil comprises at least a portion of at least one of the following: a ball, a cylinder, and a cone.

16. The apparatus of claim 1, further comprising a hole configured to accept a hanger.

17. The apparatus of claim 1, wherein the first raised portion completely encloses the anvil.

18. The apparatus of claim 1, further comprising a locking strap.

19. The apparatus of claim 1, further comprising a ridge on the first arm on a side opposite to the side partially enclosing the first blade.

20. The apparatus of claim 1, wherein at least a portion of the edge of the first blade comprises steel.

21. The apparatus of claim 1, wherein at least a portion of the edge of the first blade comprises ceramic.

22. The apparatus of claim 1, wherein at least a portion of the edge of the first blade comprises plastic.

23. The apparatus of claim 1, wherein the first arm is a base.

24. The apparatus of claim 1, wherein the second arm is a base.

25. The apparatus of claim 1, wherein the second arm comprises a second raised portion that is juxtaposable against a second segment of the central portion of the edge of the first blade.

26. The apparatus of claim 1, further comprising a second blade, wherein the first arm partially encloses the second blade in a manner that exposes at least a portion of an edge of the second blade, and wherein a second raised portion is juxtaposable against the second blade.

* * * * *